US011020868B2

(12) United States Patent
Laurikainen

(10) Patent No.: US 11,020,868 B2
(45) Date of Patent: Jun. 1, 2021

(54) CUTTING DIE FOR ROTARY DIE-CUTTING OF LABEL LAMINATES

(71) Applicant: UPM Raflatac Oy, Tampere (FI)

(72) Inventor: Eliisa Laurikainen, Pirkkala (FI)

(73) Assignee: UPM RAFLATAC OY, Tampere (FI)

( * ) Notice: Subject to any disclaimer, the term of this patent is extended or adjusted under 35 U.S.C. 154(b) by 71 days.

(21) Appl. No.: 16/186,869

(22) Filed: Nov. 12, 2018

(65) Prior Publication Data

US 2019/0143549 A1 May 16, 2019

(30) Foreign Application Priority Data

Nov. 14, 2017 (EP) ..... 17201539

(51) Int. Cl.

| | |
|---|---|
| ***B26D 1/40*** | (2006.01) |
| ***B26D 5/00*** | (2006.01) |
| ***B26F 1/38*** | (2006.01) |
| ***B26F 1/44*** | (2006.01) |
| ***B26D 1/00*** | (2006.01) |
| ***B26D 7/20*** | (2006.01) |

(52) U.S. Cl.

CPC ..... *B26D 1/405* (2013.01); *B26D 1/0006* (2013.01); *B26D 5/00* (2013.01); *B26D 7/204* (2013.01); *B26F 1/384* (2013.01); *B26F 1/44* (2013.01); *B26D 2001/0053* (2013.01); *B26D 2210/11* (2013.01); *B26F 2001/4463* (2013.01); *B26F 2001/4472* (2013.01); *B26F 2001/4481* (2013.01)

(58) Field of Classification Search

CPC ..... B26D 1/405; B26D 1/0006; B26D 5/00; B26D 7/204; B26D 2210/11; B26D 2210/0053; B26F 1/384; B26F 1/44; B26F 2001/4481; B26F 2001/4463

USPC ..... 83/677, 623, 627

See application file for complete search history.

(56) References Cited

U.S. PATENT DOCUMENTS

| | | | | |
|---|---|---|---|---|
| 5,687,622 | A * | 11/1997 | Gerhardt | B23P 15/406 216/52 |
| 5,789,050 | A * | 8/1998 | Kang | B26F 1/18 283/71 |
| 5,916,335 | A | 6/1999 | Gerhardt | |
| 2008/0041206 | A1 | 2/2008 | Mergola et al. | |
| 2011/0318557 | A1 | 12/2011 | Mitchell | |
| 2015/0033920 | A1 | 2/2015 | Bayzelon et al. | |

* cited by examiner

*Primary Examiner* — Kenneth E Peterson
*Assistant Examiner* — Nhat Chieu Q Do
(74) *Attorney, Agent, or Firm* — Cantor Colburn LLP

(57) ABSTRACT

A cutting die for rotary die-cutting of a label laminates is described herein. The cutting tools of the die include at least one of the following cutting edge parameters: effective height, shape and bevel angle arranged to be different in a first direction when compared to a second direction of the cutting die. The use of the cutting die, a method for designing a cutting die and a method for die-cutting a label laminate are also described.

13 Claims, 4 Drawing Sheets

CUTTING DIE FOR ROTARY DIE-CUTTING OF LABEL LAMINATES

CROSS-REFERENCE TO RELATED APPLICATIONS

This application claims the benefit of European Patent Application No. 17201539.8, filed Nov. 14, 2017, which is incorporated by reference herein in its entirety.

TECHNICAL FIELD

The application relates to a cutting die comprising cutting tools for optimized die-cutting of the label laminate webs and use of the cutting die for die-cutting of label laminate web. Further it relates to a method of designing a cutting die and to a method for die-cutting a label laminate.

BACKGROUND

Typical pressure sensitive adhesive label laminate webs and labels produced thereof comprise a face layer i.e. a facestock, which carries printed information, a pressure sensitive adhesive layer and a release liner removably adhered to the adhesive layer. The label production includes die-cutting of the label laminate web so as to provide individual labels with predefined shape and size to be subsequently labelled to the surface of an item through the pressure sensitive adhesive layer. Cutting may be performed, for example in either flat or rotary format. Rotary cutting permits a continuous pass of the label laminate web through the cutting phase thus providing increased overall throughput when compared to flat cutting. After cutting the waste matrix margins around the cut labels are stripped away as a continuous skeleton. There is a growing demand for cutting of thin, small, random and/or irregular shaped labels, which provides challenges for the die-cutting phase and cutting tools. In addition high converting speeds, including both die-cutting and dispensing of the labels with high speeds are preferred. These provide further demands for the optimal label converting steps, such as die-cutting process.

SUMMARY

It is an aim of the embodiments to provide a cutting die suitable for rotary die-cutting of label laminates. Further it is an aim to provide a method of designing a cutting die, use of the cutting die and method for die-cutting a label laminate. One embodiment provides a cutting die for rotary die-cutting of a label laminate web. The cutting die comprises cutting tools having cutting edges projecting out from a base surface of the cutting die. The cutting edges are arranged at least in a first direction and a second direction along the base surface of the cutting die. At least one of the following parameters of the cutting edges: effective height, shape and bevel angle is arranged to be different in the first direction when compared to the second direction so as to provide the cutting tool comprising asymmetric cutting tools.

One embodiment provides use of the cutting die for rotary die-cutting of a label laminate web so as to form individual labels attached on a release liner.

One embodiment provides a method of designing a cutting die for rotary die-cutting of a label laminate. The method comprises at least the following steps: selecting a label laminate to be die-cut; determining the difference in the die-cutting properties of the label laminate in a first direction and a second direction along the plane of the label laminate; analyzing the total number and shape of the individual labels to be die-cut for specifying their features to be aligned along the first direction and second direction of the label laminate; optimizing at least one of the following parameters of the cutting edges: effective height, shape and bevel angle separately for the cutting edges arranged in the first direction and in the second direction along the base surface of the cutting die. The optimizing of the cutting edge parameter(s) is based on the determined difference in the die-cutting properties of the label laminate and the specified features of the labels to be aligned along the first direction and the second direction of the label laminate.

One embodiment provides a method for die-cutting a label laminate. The method comprises at least the following steps: providing a cutting die of the rotary die-cutting machine; arranging the label laminate to be cut between an anvil roll and the cutting roll comprising the cutting die spaced from the anvil roll; providing a cutting pressure so as to provide a cutting force cutting a facestock layer and an adhesive layer of the label laminate by the cutting edges of the cutting tools of the cutting die in the nip line.

Further embodiments of the application are presented in the dependent claims.

In an example the cutting tools have the difference of the effective height between the cutting edges in the first direction and in the second direction between 5 and 15 μm.

In an example the cutting die is a sheet and the sheet comprises further material layer on the surface opposite to the base surface so as to provide difference of the effective height between the cutting edges in the first direction and in the second direction. A further material layer (12) can be as shown in FIG. 9.

In an example the cutting tools have the difference of the bevel angle between the cutting edges in the first direction and in the second direction between 5 to 25°.

In an example the cutting edge directions are as follows: the first direction corresponds to a transverse direction of the cutting die and the second direction is perpendicular to the first direction.

In an example the transverse direction of the cutting die is parallel to the transverse direction of the label laminate to be cut.

In an example determining the difference in the die-cutting properties of the label laminate involves measuring die-cutting force in the first direction corresponding to a transverse direction and in the second direction corresponding to a machine direction of the label laminate.

In an example analyzing the total number and shape of the individual labels involves determining a maximum contact length and a minimum contact length of the cutting edges of the cutting tools to be contacting the label laminate surface in a nip line of a rotary die-cutting machine.

In an example the maximum contact length of the cutting edges corresponds to the transverse direction of the label laminate.

In an example the label laminate to be cut has a plastic face stock layer having asymmetry based on different orientation ratio in machine direction in comparison to transverse direction of the facestock.

In an example the plastic facestock layer is uniaxially oriented in the machine direction.

In an example the plastic facestock layer has the die-cutting force in transverse direction higher than in machine direction.

In an example the cutting edges in the first direction of the cutting tools are arranged parallel to the transverse direction of the label laminate and the cutting edges in the second direction are arranged parallel to the machine direction of the label laminate.

In an example the method comprises adjusting the cutting pressure so as to enable higher die-cutting force in the transverse direction when compared to the machine direction of the label laminate through providing difference in height, shape and/or bevel angle of the cutting edges in the first direction when compared to the cutting edges in the second direction for diminishing the difference in the die-cutting force.

In an example the cutting die is arranged so that a maximum total contact length of the cutting edges is arranged parallel to the transverse direction of the label laminate.

BRIEF DESCRIPTION OF THE DRAWINGS

In the following some examples and embodiments of the invention will be described in more detail with reference to appended drawings, in which.

DETAILED DESCRIPTION

Figure 1:
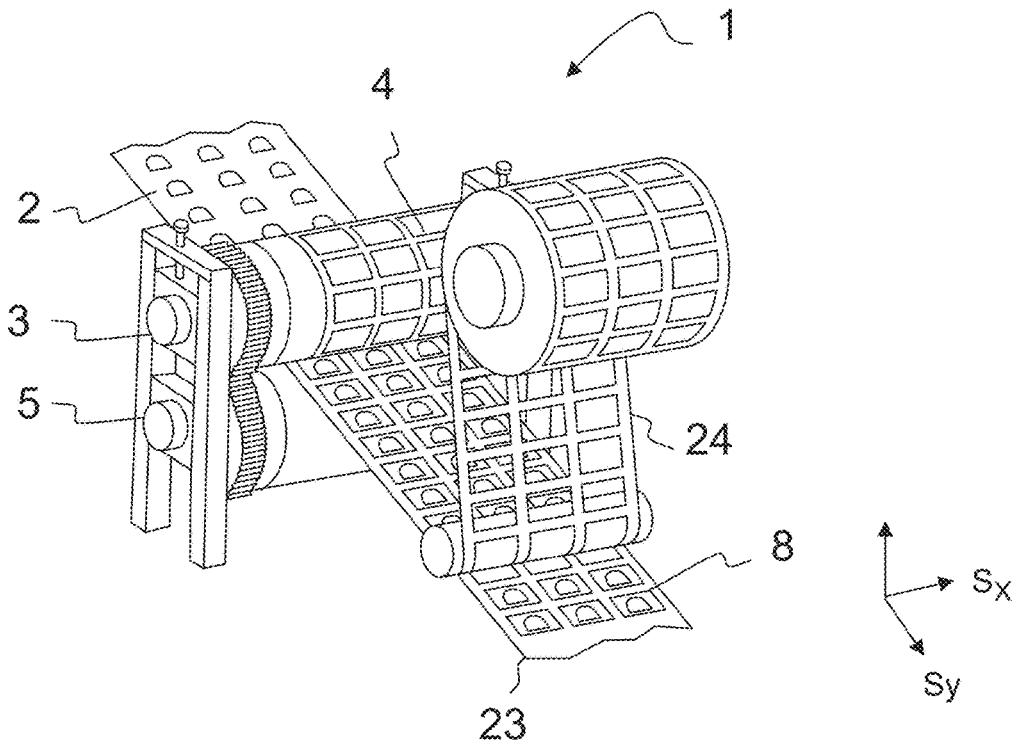
FIG. 1 is a an example of a rotary die-cutting process.

In this description and claims word "comprising" may be used as an open term, but it also comprises the closed term "consisting of". The following reference numbers and denotations are used in this application:

1 a rotary die-cutting machine,
2 a label laminate web,
3 a cutting roll,
4 a cutting tool,
5 an anvil roll,
6 cutting edge,
7 a label roll,
8 a label,
9 a base surface of the cutting die,
10 a cutting sheet,
11 a bottom surface of the cutting sheet,
12 a further material layer,
21 a face layer,
22 an adhesive layer,
23 a release liner,
24 a waste matrix,
TD transverse direction,
MD machine direction,
$E_{TD}$ cutting edge in transverse direction,
$E_{MD}$ cutting edge in machine direction,
$A_{tot}$ total amount of the label outlines to be cut simultaneously,
$B_{tot}$ total amount of the label outlines to be cut simultaneously,
B1-B4 cutting points (locations),
CL contact length,
a a bevel angle,
h a height of the cutting edge,
$h_{eff}$ an effective height of the cutting edge.

Term "machine direction" MD refers to the running direction Sy of the face film or continuous label web during label manufacturing. "Transverse direction" TD or "cross direction" CD refers to the direction Sx perpendicular to the running direction Sy of the film or label web. Directions are shown, for example, in FIG. 1.

It is a trend in label development to use ever thinner material layers in the label laminate structures, such as facestock layer and release liner layer. This trend is supported both by material savings and also by lower environmental impact due to lower amount of waste. Further, in some end use areas the thinner material layers enable creating the so called "no label" look. No-label look makes the label itself less visually evident for the consumer and allows the printed information, such as the brand, to become better promoted.

Especially in case of plastic film materials, the reduced thickness creates challenges in label laminate manufacturing, label converting and also in label dispensing phases. This has led to the development of different type of plastic films, for example asymmetrically oriented films. One example of these asymmetrically oriented films are machine direction oriented (MDO) films. MDO films are substantially oriented only in the machine direction. Machine direction orientation creates improved stiffness and other physical properties in the said direction and helps, for example, dispensing of the labels when using the traditional dispensing tip based methods.

Nowadays there exists a wide variety of films ranging from those having been fully symmetrically oriented i.e. the films having the same amount of orientation both in machine and transverse in directions, to those which have been asymmetrically oriented to some extent up to those which have been substantially oriented only in one direction, in machine direction (MD) or in transverse direction (TD).

In this context, oriented films refer to films which in their manufacturing process have a specific MD and/or TD orientation phase. Even without such specific orientation phase, it may be understood that films may have some amount of orientation of the polymer chains which arises from other phases of their manufacturing process, for example, in blown films. However, such films are referred to as non-oriented.

An amount of orientation of the oriented films may be expressed by a draw ratio (DR). Draw ratio may also be referred to as orientation ratio. Draw ratio is a ratio of non-oriented (undrawn) film thickness to the oriented (stretched) film thickness. The non-oriented film thickness is the thickness after extrusion and subsequent chilling of the film. When stretching the film, the thickness of the film may diminish in the same ratio as the film stretches or elongates. For example, a film having thickness of 100 micrometers before uniaxial orientation is stretched by a stretch ratio of 5. After the uniaxial orientation the film may have a fivefold diminished thickness of 20 micrometers. Thus, the draw ratio of the film is 5.

Die-cutting is a label converting phase where the circumference of the individual labels are kiss cut through the face layer but leaving the underlying release liner intact to carry the individual labels to the later label dispensing phase. In this same converting phase the so-called waste matrix 24 is removed, i.e. the excess label material between the individual labels is removed, as shown in FIG. 1. The release liner 23 carries the individual labels 8 that are ready to be transferred on the labelled item later in the dispensing phase. A continuous liner including plurality of individual labels is reeled on a roll, typically narrowed down into one label width.

Due to the ever thinning label face and liner materials, as well as due to the introduction of asymmetrically oriented materials, the die-cutting phase is becoming more and more challenging. A proper die-cutting is needed to ensure that the following process steps, such as matrix stripping, reeling, dispensing phase, can be performed flawlessly and the dispensed label has flawless visual and tactile properties.

Die-Cutting

Die-cutting of the labels may be provided through rotary die-cutting. With reference to FIG. 1, during rotary die-cutting phase the label laminate is die-cut by means of the cutting tools 4 i.e. profiles formed on the rotating cutting roll 3 and which cut the label laminate web 2 when exposed to pressure. During cutting, the label laminate web 2 is supported against the surface of the anvil roll 5, which is accurately spaced from the cutting roll 3 e.g. by a roll spacer or bearer members associated with each roll. Clearance i.e. gap between the cutting roll and the anvil roll may be 480 μm.

Cutting roll comprises cutting tools 4 on the surface of the roll. In general, the cutting tool 4 severs the face material layer 21 of the label laminate and penetrates the pressure-sensitive adhesive 22 and barely contacts the underlying liner material 23. In die-cutting liner damages should be avoided, so as to prevent liner breaks e.g. during subsequent reeling of the label web comprising cut labels and label dispensing process. Also adhesive leaks should be avoided, so as to avoid the layers in the label roll 7 stick to each other and provide malfunctions during dispensing of the labels.

Figure 3:
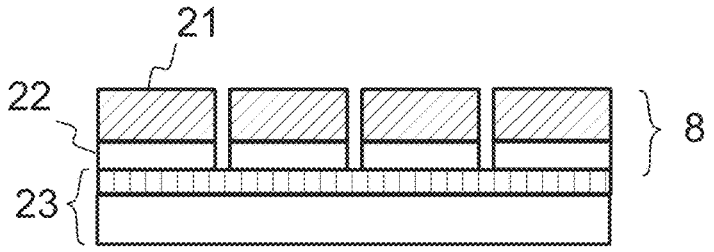
FIG. 3 shows a structure of a label laminate and cut labels.
Figure 4:
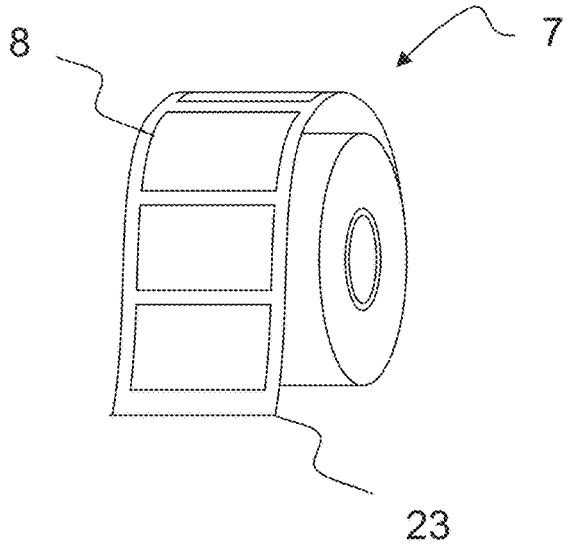
FIG. 4 is a roll of die-cut labels.

Challenges in the rotary die-cutting process arise not only from the high converting speeds but also from the label laminate structure. The label laminate structure includes a face material layer 21, an adhesive 22 and a release liner 23, as shown in FIG. 3. During die-cutting phase the adhesive material and the face material need to be properly cut, whereas the release liner including a release layer and a substrate should remain intact. This ensures, for example, successful separation of the waste matrix 24 from the release liner 23 without the waste matrix becoming snapped off when collecting it away during die-cutting. Undamaged liner on the other hand prevents breaks e.g. during label the actual dispensing process. In FIG. 3 it is shown four die-cut labels 8 consisting of the face material layer 21 and the adhesive layer 22 attached on the release liner 23. Proper cutting of the adhesive layer has effect on e.g. avoiding the layers in the label roll 7 stick to each other. A roll of die-cut labels on a continuous liner is shown in FIG. 4.

In the die-cutting process the face material layer 21 of the label laminate web 2 is compressed by the cutting tool 4 until it bursts. Especially challenging is to cut thin label laminates and/or laminates including thin plastic liners, such as a PET liner. It is also challenging to cut laminates, when total length of outlines of the labels to be cut simultaneously is long in TD direction of the web, since high cutting pressure is needed for the cutting. Such labels have typically circumference of polygon, such as triangle, square, rectangle etc. with long line type features present in TD direction. High cutting pressure may result defects in machine direction of the laminate web, since the total length of outlines of the labels to be simultaneously cut is normally changing during the rotation of the cutting roll 3, as shown in FIG. 2.

Figure 2:
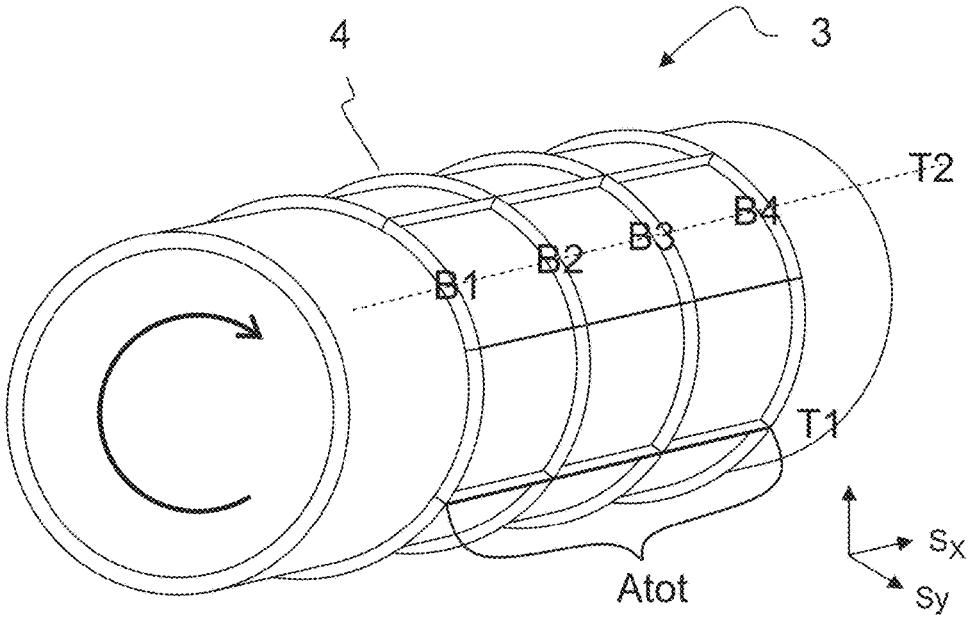
FIG. 2 is an example of a cutting tool.
Figure 8:
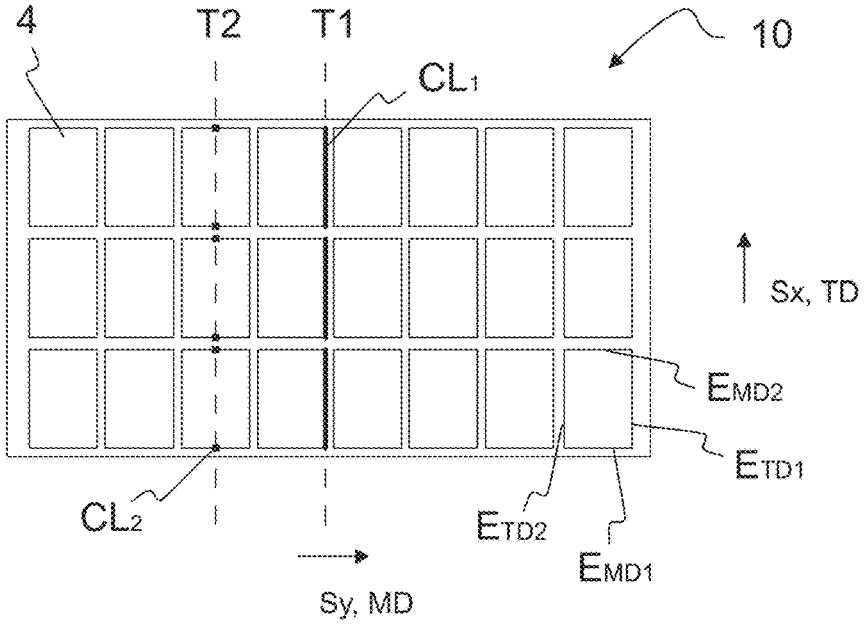
FIG. 8 shows an example of a cutting sheet comprising plurality of cutting tools.
Figure 9:
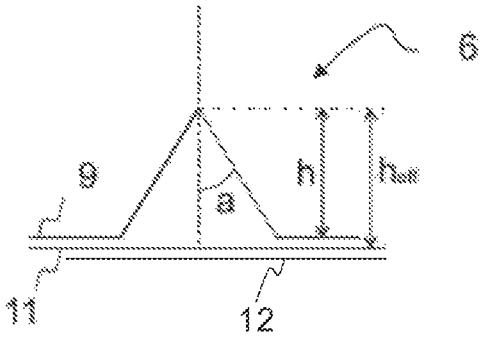
FIG. 9 shows an example of a cutting edge of a cutting tool.

In FIG. 2 overall length of the individual cutting points (cutting locations) B1-B4 corresponds to the total length of outlines $B_{tot}$ of the labels to be simultaneously cut at time point $T_2$. $A_{tot}$ refers to the total length of outlines of the labels to be simultaneously cut at time point $T_1$. Total length of outlines to be cut simultaneously corresponds to a total contact length CL of the cutting edges of the cutting tools contacting the label laminate surface in the nip line. With reference to FIG. 1, the nip line has a direction Sx, which corresponds to the transverse direction TD of the label laminate web 2. Nip line direction also corresponds to the transverse direction TD of the cutting die, as shown in FIG. 8. In other words, during cutting the nip line refers to a contact line in Sx direction which is created between the cutting roll 3 and the anvil roll 5.

With reference to FIG. 8, a total contact length $CL_{T1}$ of the cutting edges of the separate cutting tools 4 contacting the laminate surface in the nip line at time point T1 consists of three separate contact lengths $CL_1$. In other words, total contact length $CL_{tot1}$ in the nip line (in the transverse direction of the cutting die) 10 consists of the lengths of the cutting edges $E_{TD}$ of the cutting tools 4. A total contact length $CL_{T2}$ of the cutting edges of the separate cutting tools 4 contacting the label surface in the nip line at time point T2 consists of six separate contact lengths $CL_2$. In other words, total contact length $CL_{tot2}$ in the nip line consists of the contact lengths of the cutting edges $E_{MD1}$ and $E_{MD2}$ of the cutting tools 4. Total contact length $CL_{tot1}$ corresponds to maximum total contact length of the cutting edges $E_{TD}$ contacting the laminate surface in the nip line. Total contact length $CL_{tot2}$ corresponds to minimum total contact length of the cutting edges $E_{MD1}$ and $E_{MD2}$ of the cutting tools contacting the laminate surface in the nip line. Number and shape of the individual labels to be die-cut have effect on the features, such as total length of contour lines to be cut and aligned along the machine direction and transverse direction of the label laminate. Thus also affecting the minimum and maximum total contact lengths of the cutting edges in the nip line.

With reference to FIG. 2 and when observing along the nip line in direction Sx, at time point T2 where cutting edges at cutting locations B1, B2, B3 and B4 are arranged between the cutting roll 3 and the anvil roll 5, the predetermined nip pressure is effecting (or divided) only between these cutting locations. Thus the effective cutting pressure on each of these cutting edge locations remains high. Cutting edge locations B1-B4 exists on the cutting edges in the machine direction MD (corresponding to direction Sy) of the cutting tools 4. On the other hand at time point T1, when cutting edges of the cutting tools 4 existing in TD (Sx) are arranged between the cutting roll 3 and the anvil roll 5, the nip pressure effects along greater total contact length corresponding to $A_{tot}$. Thus the effective cutting pressure along the cutting edges in TD becomes significantly decreased.

During die-cutting there may arise problems in across web direction i.e. in TD direction of the web. In an example, if total length of outlines of the label to be cut simultaneously in time point $T_1$ is high in TD direction of the web, the higher cutting pressure is needed for these lines to be cut cleanly. Higher cutting pressure may shorten the lifetime of the cutting tools. It may also cause liner damages in the machine direction of the web. The total length of outlines $B_{tot}$ of the labels to be cut simultaneously at time point T2 may be considerably lower and thus the cutting pressure per each outline point B1-B4 to be cut is higher when compared to outlines $A_{tot}$ at time point $T_1$. Total length of outlines of the web to be cut simultaneously may be reduced by unsymmetrical arrangement, such as staggering of the cutting tools formed on the cutting die. Due to the staggering also the cutting pressure required to cut the labels is reduced thus decreasing the defects caused to the liner. However, matrix stripping process may become more challenging. Alternatively, the liner may be separated from the laminate prior to the die-cutting and relaminated after the die-cutting. However, the overall die-cutting process becomes more complicated. Especially in the rotary die-cutting, the following phenomena have been observed.

Firstly, the physical impact of the cutting edges in rotary die-cutting are different for TD oriented cutting edges and cutting edges deviating from the transverse direction, such as edges in machine direction MD which is perpendicular to the TD. Namely, the MD oriented edges behave more like slash cutting tools when the knife edges progress in rotary manned through the face material. Whereas e.g. the TD oriented edges roll sideways and are pushed through the face material for all of their width in a manner resembling more like piercing or punching. This leads to the situation that typically more force and pressure is required for the TD oriented cutting edges to kiss cut cleanly through the face material than in case of MD oriented cutting edges. For non-rectangular die-cutting shapes there naturally exists locations in their circumference where the die-cutting in that position has both MD and TD elements due to the direction of the cutting edge.

Secondly, if asymmetrical face materials are used, these will have different physical properties in MD and TD and therefore they will also behave differently when die-cut in MD and TD. As an example, a machine direction oriented film is easier to cut in MD than it is to cut in TD.

Based on above, there is still need for development of the die-cutting process and the die-cutting tools. Especially when die-cutting thin oriented materials.

Label Laminate

With reference to FIG. 3, the label laminate comprises a facestock 21, a release liner 23, and an adhesive layer 22 between the facestock and the liner. The release liner consist of a substrate and a release layer. Thickness of the release layer, such as silicone layer, may be 1 μm. The release layer is adjacent to the adhesive layer.

The facestock may include or consist of a paper or polymeric materials, such as polyolefins, polyesters, polyamides etc. The facestock may have a monolayer structure. Alternatively it may have a multilayer structure. The facestock has effect on at least one of the following: printability, die-cuttability and dispensability. Thickness of the facestock may be from 10 to 100 μm. Typically the thickness is in the range of 20-60 μm.

The face material of the label has effect on the cutting. For example paper ruptures relatively quickly when compressed, whereas the plastic film materials must be almost fully penetrated by the cutting tool. In an example cutting edge of the tool will be required to penetrate about 90% to properly cut the polyethylene based face material. In an example cutting edge of the tool will be required to penetrate at least about 50% to properly cut the polypropylene and PET based face material. In an example cutting edge of the tool will be required to penetrate about 50% or less to properly cut the paper based face material.

Not only the facestock material but also the orientation of the plastic facestock has effect on the cutting. The plastic facestock may be asymmetric. Asymmetry may be based on e.g. different orientation ratios in machine and transverse direction of the film. In an example, the face material may be uniaxially oriented in machine direction so as to provide MDO film. Alternatively the film may be oriented in both MD and TD of the film so as to provide biaxially oriented film. The biaxially oriented film may further have different degree of orientation in MD and TD.

Different face materials were tested so as to measure die-cutting force. 10 parallel samples were tested using 90 degree die-cutting tool which corresponds to the cutting tool having the bevel angle α of 45°. The results are shown in Table 1. With reference to the tested face materials MDO refers to machine direction oriented polyolefin film having orientation ratio of 6 and thickness of 53 μm;

Blown PE refers to biaxially oriented blown polyethylene film (comprising MD and TD orientation ratios close to each other) having thickness of 64 μm; BOPP refers to biaxially oriented polypropylene film having thickness of 51 μm and orientation ratio about 5 in MD and about 9 in TD.

TABLE 1

| Face material | Force [N/15 mm)] MD (st dev) | Force (N/15 mm) TD (st dev) |
|---|---|---|
| MDO | 162 (17.1) | 220 (20.5) |
| Blown PE film | 167 (19.4) | 179 (13.6) |
| BOPP film | 298 (15.5) | 197 (10.9) |

Based on the test results it can be observed that there is a difference in force required to cut the sample with respect to the orientation direction. With machine direction oriented film (MDO) the die-cutting force in TD of the film is 36% higher than in MD. With machine direction biaxially oriented polyethylene film (Blown PE) the die-cutting force in TD of the film is 7% higher than in MD. With biaxially oriented polypropylene film (BOPP) the die-cutting force in MD of the film is 51% higher than in TD.

An asymmetry of the face material, e.g. based on the orientation of the film, may have effect on die-cutting tool optimization. In an example, an asymmetry leading to the difference in the cutting force required to cut the material in transverse and machine directions has effect on die-cutting tool optimization, such as optimized edge profile in the machine direction and transverse direction of the cutting tool, so as to enable clear cutting in both directions.

In addition, the liner material may have effect on the cutting. A standard glassine liner can be compressed and it is able to absorb some of the pressure of the penetrating cutting tool, making it less sensitive to damages. Thin PET liner is practically incompressible and particularly sensitive to damage from the cutting tool. Thickness of the PET liner may be 23 μm. Also adhesive may have effect on the cutting. For example, high tack, hot melt and/or rubber based adhesive may have effect on a bevel angle of the cutting edge. Thickness of the adhesive layer may be 15 μm.

There is a need to optimize the cutting process including cutting tools not only based on the shape and size of the label to be cut but also based on the structure of the label laminate, properties and composition of the layers of the laminate.

Cutting Dies

A cutting die comprises plurality of cutting tools for cutting the label laminate so as to form individual labels. Cutting tools are arranged to cut the outlines of the labels. Cutting die may be made from solid bar of metal (e.g. steel) around which the cutting tools are etched or engraved, leaving them projecting from the base surface of the cutting die. Such cutting die may be referred to as a solid cutting die. A solid die forms a cutting roll. Alternatively, cutting die may be a flexible sheet (plate) of metal, such as steel. Cutting tools may be chemically etched on the sheet leaving the desired cutting lines (cutting profiles) standing out for cutting the labels. Such flexible sheet comprising cutting tools is mounted on a cutting cylinder i.e. on a surface of roll, for example magnetically so as to form the cutting roll. A flexible sheet comprising cutting tools may be referred to as a flexible cutting die. With reference to FIG. 2, a cutting roll including plurality of cutting tools 4 is illustrated. In FIG. 8 a cutting sheet 10 including plurality of cutting tools 4 is illustrated.

The cutting tools include cutting lines (cutting edges) projecting from the base surface of the cutting die. The cutting lines are deviating from each other in planar directions. In an example a rectangular cutting tool comprises cutting edges $E_{MD}$ in machine direction and cutting edges $E_{TD}$ in transverse direction of the cutting sheet. The cutting edges $E_{MD}$, $E_{TD}$ are perpendicular to each other. Thus, a cutting tool comprises cutting edges in a first direction and in at least one direction deviating from the first direction in the same planar.

The shape of a label to be cut, a label laminate structure, properties, and material(s) of the laminate layers to be cut have effect on the design of the cutting tool 4. The cutting die, such as a flexible sheet 10 comprises cutting tools 4 having cutting lines attaching the label laminate during cutting. The cutting lines are arranged in the same plane with deviating directions so as to form cutting lines corresponding to the outlines of the label. The cutting sheet 10 may comprise plurality of cutting tools 4 as shown in FIG. 8. Cutting lines may also be referred to as cutting edges projecting from the base surface. A bevel angle, height and/or shape of the cutting edge may be varied. The design of the cutting tool may have effect on providing die-cutting process with optimal cutting pressure distribution over the cutting die in the nip line. Optimal cutting pressure distribution enables proper cutting of the labels without liner damages. It may also enable cutting without adhesive leaks.

Figure 5:
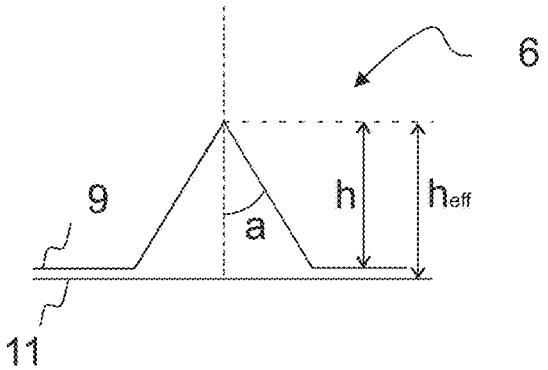
FIG. 5 is an example of a cutting edge of a cutting tool.

The edge of the cutting tool has specific bevel angle a, as shown in FIG. 5. The bevel angle depends on the label laminate construction e.g. total thickness of the laminate and the materials to be cut. Bevel angle may be for example 30°, 35° or 45°. The bevel angels correspond to the cutting angles 60, ° 70° and 90° of the cutting tool, respectively. For example wide bevel may be preferred for a laminate comprising paper based face or a high tack or rubber based adhesive. Wide bevel may have effect on holding the cut "open" until the waste matrix has been stripped away. Wide bevel angle may be e.g. above 40°, for example 45°. Steeper angle is preferred for filmic materials, such as polyethylene and polypropylene. In an example the angle may be 30° or 35°. A bevel angle has effect on the force required to break (cut) the material. Different face materials were tested so as to measure die cutting force. 10 parallel samples were tested using 90 degree die-cutting tool which corresponds to the cutting tool having the bevel angle of 45°. 10 parallel samples were tested using 70 degree die-cutting tool which corresponds to the cutting tool having the bevel angle of 35°. 10 parallel samples were tested using 60 degree die-cutting tool which corresponds to the cutting tool having the bevel angle of 30°. The results are shown in Table 2.

With reference to the tested materials

MDO refers to machine direction oriented polyolefin film having orientation ratio of 6 and thickness of 53 μm;

Blown PE refers to biaxially oriented blown polyethylene film (comprising MD and TD orientation ratios close to each other) having thickness of 64 μm; BOPP refers to biaxially oriented polypropylene film having thickness of 51 μm and orientation ratio about 5 in MD and about 9 in TD.

TABLE 2

| Face material | 90° die-cut tool; Force [N/15 mm] MD (st dev) | 70° die cut tool; Force [N/15 mm] MD (st dev) | 60° die cut tool; Force [N/15 mm] MD (st dev) | 90° die-cut tool; Force [N/15 mm] TD (st dev) | 70° die-cut tool; Force [N/15 mm] TD (st dev) | 60° die cut tool; Force [N/15 mm] TD (st dev) |
|---|---|---|---|---|---|---|
| MDO | 162 (17.1) | 141 (13.7) | 112 (7.0) | 220 (20.5) | 205 (8.6) | 149 (14.4) |
| Blown PE film | 167 (19.4) | 151 (20.1) | 149 (4.8) | 179 (13.6) | 168 (13.9) | 151 (4.8) |
| BOPP film | 298 (15.5) | 273 (11) | 183 (10.0) | 197 (10.9) | 165 (16.2) | 165 (7.8) |

Based on the test results it can be observed that there is a difference in force required to cut the sample with respect to the cutting angle. In general less force is required when using steeper bevel angle of 35° (corresponding to the die-cut tool of 70°) or 30°, when compared to force required when using bevel angle of 45°.

An individual cutting tool may have various bevel angles. The cutting tool may have various bevel angles so as to enable proper cut of the outlines of the label without adversely affecting the underlying release liner. A bevel angle of the cutting tool is dependent on the maximum total contact length and minimum total contact length of the cutting edges contacting the label surface in the nip line. In addition, the bevel angle may be dependent on the die-cutting properties, such as die-cutting force of the label laminate in a machine and transverse directions.

In an example, a cutting tool 4 may have a bevel angle of the cutting edge in transverse direction of the cutting tool steeper when compared to the bevel angle in machine direction of the cutting tool. Cutting edge may have cutting angle between 50 and 100° or between 60 and 90°. The cutting angle corresponds to the bevel angle between 25 and 50° or between 30 and 45°. The difference of the bevel angle between the cutting edges in the machine direction and the cutting edges in the transverse direction may be between 5 to 25° or between 5 to 15°.

The depth that the bevelled cutting edge of the tool will be required to penetrate before the face material and the adhesive layer is properly cut has effect on the height of the cutting line. Height of the cutting line is also referred to as height of the cutting edge h projecting from the base surface 9 of the cutting tool, as shown in FIG. 5. Effective height $h_{eff}$ of the cutting edge refers to the height of the cutting edge measured from tip of the cutting edge to the bottom surface 10 of the cutting sheet i.e. flexible die comprising the cutting tools projecting out from the base surface, as shown in FIG. 5. The bottom surface 10 is opposite to the base surface 9 of the sheet. Effective height of the cutting edges provided on a solid bar of metal i.e. effective height of the cutting edge of the solid die equals to the height h of the cutting edge measured from the base surface of the cutting die onto the tip of the cutting edge. An individual cutting tool may have various heights of the cutting lines. A cutting die comprising plurality of cutting tools having edges projecting out from a base surface and arranged at least in a first direction and a second direction along the base surface has height of the cutting edges same in the first direction but different from the second direction.

According to an example a cutting die comprising rectangular or square cutting tools 4 have equal height of the cutting edges in the first direction, such as parallel to the transverse direction ($E_{TD1}$, $E_{TD2}$) and in the first direction, such as parallel to the machine direction ($E_{MD1}$, $E_{MD2}$). However the cutting edges in the first direction have different height in comparison to the height of the cutting edges in the second direction. Same applies to the other cutting edge parameters, such as shape and bevel angle.

The cutting tool having specific cutting height profile may have effect enabling proper cut of the outlines of the label without adversely affecting the underlying release liner. A height profile of the cutting tool is dependent on the ratio between maximum and minimum total lengths of outlines of the labels to be cut at predetermined time points. In other words cutting edge height in a first direction of the cutting tool and in at least one direction deviating from the first direction of the cutting tool is dependent on the maximum total contact length and minimum total contact length of the cutting edges contacting the label surface in the nip line. In addition, the height profile may be dependent on the die-cutting properties, such as die-cutting force of the label laminate in a machine and transverse directions.

Figure 6:
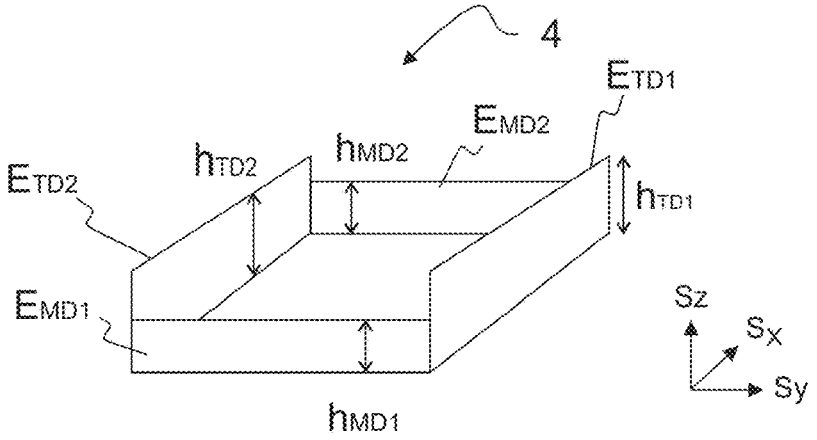
FIG. 6 is an example of a various heights of a cutting edge.

In an example, a cutting tool 4 may have the height of the cutting edges cutting the label in transverse direction $h_{TD1}$, $h_{TD2}$ of the label web greater when compared to the height of the cutting edges in machine direction $h_{MD1}$, $h_{MD2}$ as illustrated in FIG. 6. In an example, a cutting tool 4 may have the height of the cutting edges cutting the label in transverse direction $h_{TD1}$, $h_{TD2}$ of the label web lower when compared to the height of the cutting edge in machine direction $h_{MD1}$, $h_{MD2}$. As shown in FIG. 6, an asymmetric cutting tool 4 has difference in height of the cutting edges in machine direction in comparison to the cutting edges in transverse direction of the cutting tool 4. However the cutting tool has symmetry of the cutting edges $E_{MD1}$, $E_{MD2}$ projecting out from the base surface in machine direction i.e. the cutting edges are identical. Correspondingly the cutting edges $E_{TD1}$, $E_{TD2}$ projecting out from the base surface in transverse direction are identical.

According to an example, a difference between the height of the cutting lines (cutting edges) in a first direction of the cutting tools and in at least one direction deviating from the first direction may be less than 25 μm, for example between 5 and 15 μm. In an example a difference between the height of the cutting edges in a first direction which corresponds to transverse direction of the cutting die and the cutting edges in a second direction perpendicular to the first direction may be less than 25 μm, for example between 5 and 15 μm. Height tolerance of the cutting edges of the cutting tool may be less than 3 μm.

Figures 7A, 7B, 7C:
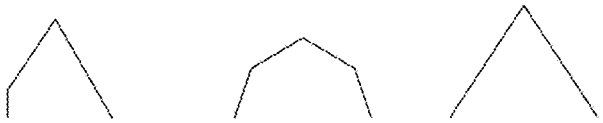
FIG. 7 shows a cutting edge having side bevel (a), a long center bevel (b), and a center bevel (c)

In addition cutting edge shape may be varied. Some examples of different cutting edge profiles are illustrated in FIGS. 7 *a-c*. In an example, a cutting tool 4 may have the cutting edge profile of the cutting line cutting the label in a first direction, such as transverse direction, of the label web different when compared to the profile in the second direction, such as machine direction. FIG. 7 *a*) shows a cutting edge having side bevel, b) shows a long centre bevel and c) shows a cutting edge having centre bevel.

Method of Designing a Cutting Die

For providing optimized cutting die for rotary die-cutting of individual labels the method of designing may comprise at least the following steps:

- selecting a label laminate to be die-cut;
- determining the difference in the die-cutting properties of the label laminate in at least a first direction and a second direction along the plane of the label laminate;
- analyzing the total number and shape of the individual labels to be die-cut for specifying their features to be aligned along the first direction and second direction of the label laminate;
- optimizing at least one of the following parameters of the cutting edges of the cutting tools:
  - effective height,
  - general shape and
  - bevel angle
- separately for the cutting edges arranged in the first direction and in the second direction along the base surface of the cutting die based on the determined difference in the die-cutting properties of the label laminate and the specified features aligned along the first direction and the second direction of the label laminate.

Analyzing the shape of the individual labels to be die-cut for their features to be aligned along the first direction and second direction of the label laminate is provided by specifying, for example, the total length of the contour lines of the labels to be arranged and cut in the machine and transverse direction of the label laminate.

Based on the shape and corresponding contour lines of the labels to be cut the cutting die with the cutting tools is provided. The cutting lines of the cutting tool i.e. outlines of the cutting edges of the cutting tool are arranged onto a surface of the cutting die. In other words, the cutting edges are projecting out from a base surface of the cutting die and are arranged in a first direction and a second direction along the base surface. Cutting die may be a cutting sheet or a solid bar. In an example, the cutting die comprises cutting edges in the machine direction and in the transverse direction. The parameters of the cutting edges are optimized resulting in at least one of the following parameters: cutting edge effective height, cutting edge general shape and cutting edge bevel angle to be different for the cutting edges arranged in the first direction, such as machine direction, when compared to the cutting edges arranged in the second direction, such as transverse direction. However, the parameter(s) of the cutting edges remain substantially constant along the first direction and along the second direction. According to an example, the cutting edges in the first direction are arranged to be parallel with the transverse direction of the label laminate to be cut and the cutting edges in the second direction are arranged to be parallel with the machine direction of the label laminate.

Analyzing the total number and shape of the individual labels may include determining maximum contact length and minimum contact length of the cutting edges of the cutting tools contacting the label laminate surface in a nip line of a cutting machine. The maximum contact length of the cutting edges may correspond to the transverse direction of the label laminate.

Determining the difference in the die-cutting properties of the label laminate along the plane of the label laminate in a first direction and a second direction may include measuring die-cutting force (N/15 mm) of the label laminate in a machine direction MD and in a transverse direction TD of the laminate. Die-cutting force refers to force which enables die-cutting of the facestock and the adhesive layers in said directions.

Optimizing at least one of the cutting edge parameters may include modifying the cutting tool design based on at least one of the following: predetermined cutting pressure, the measured die-cutting forces (N/15 mm), the measured maximum and minimum contact lengths of the cutting edges of the cutting tool contacting the label laminate surface on the nip line. Through optimization at least one of the following parameters: bevel angle, shape and effective height of the cutting edges in the first direction of the cutting tools (e.g. in machine direction) may be arranged to be different when compared to the cutting edges in the second direction deviating from the first direction (e.g. in transverse direction).

With reference to FIG. 8, maximum contact length of the cutting edge of the cutting tool 4 contacting the label laminate surface on the nip line is contact length $CL_1$ of the cutting edge in transverse direction $E_{TD}$. Minimum contact length of the cutting edge of the cutting tool 4 contacting the label laminate surface on the nip line is contact length $CL_2$ of the cutting edge in machine direction $E_{MD}$.

In addition the method may also include measuring the die-cutting depth of the selected label laminate, which may further be used arranging at least one of the following parameters of the cutting edges: a bevel angle of the cutting edge, a shape of the cutting edge and a height.

Preferably the height and/or the bevel angle of the cutting edges are arranged to be different in the machine direction and in the transverse direction of the cutting tool based on the predetermined cutting pressure, measured die-cutting force (N/15 mm) and maximum and minimum total contact lengths of the cutting edges of the cutting tool contacting the label laminate surface on the nip line. Thus, the cutting tool has a different edge profile in the machine direction and transverse direction of the cutting tool. Cutting tool having different edge profiles in the different edge directions may be referred to as an asymmetric cutting tool. A cutting die comprising plurality of asymmetric cutting tools may be referred to as an asymmetric cutting die. All asymmetric cutting tools of the asymmetric cutting die are similar i.e. have same edge profiles.

The cutting tool has the maximum contact length of the cutting edge parallel to the transverse direction of the label laminate to be cut. With reference to FIG. 8, a rectangular cutting tool 4 comprises cutting edges $E_{MD}$, $E_{TD}$ in machine direction and in transverse direction of the cutting sheet, wherein the directions correspond to the directions of the label laminate to be cut. The maximum contact length of the cutting edge contacting the laminate surface in the nip line consists of the cutting edge $E_{TD}$ i.e. the length of the contact point $CL_1$.

The minimum contact length of the cutting edges contacting the laminate surface in the nip line consists of the contact points of the cutting edges $E_{MD1}$ and $E_{MD2}$ i.e. the total length of contact points $CL_2$ of the cutting tool 4.

The shape of the label to be cut may be a square or a rectangular. When cutting such labels the cutting edges in a first direction of the cutting tools are parallel to the transverse direction of the label laminate and the cutting edges in at least one direction deviating from the first direction are parallel to the machine direction of the label laminate.

Optimized design of the rotary die-cutting tool including a specific bevel angle, height profile and/or shape of the cutting edge has effect on quality of the die-cutting. It may also have effect on the even wear of the cutting tool. It may also provide longer lifetime for the cutting tool. The optimized cutting edge design of rotary die-cutting tool may have effect on providing even cutting of the label laminate. The optimized cutting edge design takes into account different cutting phenomena in the MD and TD directions of the laminate web and/or different cutting properties of the label laminate layers in those directions. The optimized cutting tool has effect on providing clean and proper die-cutting of asymmetrical materials where the mechanical and physical properties effecting the die-cutting behavior is different in MD and TD.

Cutting dies with optimized cutting tool design may be manufactured by methods removing the material, adding the material or using a combination of such methods. Methods that are removing material mechanically are for example milling, cutting, grinding or engraving. A typical example of material removing chemical method is etching, including also plasma etching. Further material removing methods may also include laser based methods, where material is removed in non-contact manner using high energy laser beam.

Methods that can be used to add material on a metallic surface include different type of chemical vapour deposition (CVD) or plasma spraying methods. Different type of laser based methods can be used to directly and locally form solid metal material onto a surface, such as a surface of flexible metallic sheet. The latter includes laser based 3D printing which can be used to form the cutting edges directly onto a surface with high accuracy.

The different type of methods can be further combined to achieve the result. For example, an etched sheet may be further trimmed by mechanical or laser based grinding.

Further, in addition of treating the front surface of the sheet, the effective height of the cutting edges may be affected by treating locally the back (bottom) surface of the metal sheet. Removing locally material from back surface of the plate below a cutting edge will lower the effective height of that edge. Vice versa, adding material in same location would increase the effective height of that cutting edge and increase the nip pressure experienced along the nip line.

Suitable methods for removing or adding material locally onto the backside of the plate include all those methods mentioned above. Because the backside of the plate will not experience any direct and local mechanical wear, this gives possibility to use also some further material adding methods to raise the effective cutting edge height locally. Such methods could include, painting or coating the backside locally using, for example, paints, epoxy materials (with fillers if necessary), chemical deposition methods, 3D printing methods or any other method which can be used to grow a suitable thin material layer locally onto the backside of the plate. Further, after such treatment the backside of the plate could further be finished with finishing grinding, polishing or other after treatment.

The technical benefits of treating the backside of the plate arise from the fact that the material may be removed or added with lower requirement for the spatial accuracy along the plane of the plate. Only the total thickness of the plate needs to be carefully controlled. Further, in case of adding material onto the backside, the mechanical requirements of that material are far lower than onto front surface where the mechanical wear during use takes place.

In an example cutting tools may be manufactured by means of 3D printing. The basic body of the cutting tool as well as the cutting lines can be produced by means of 3D printing technology. Preferably, the cutting lines are applied by means of 3D printing technology to an already existing basic body, such as steel cylinder or flexible sheet. In 3D printing method, the material to be processed may be applied in powder form and completely remelted locally by means of laser radiation in order to form a solid material layer. Alternatively, laser sintering, such as selective laser sintering may be used. In laser sintering, the powder being applied is sintered or fused via laser beam. The energy, which is supplied by the laser, is absorbed by the powder and results in localized sintering thus producing the cutting lines.

Method for Die-Cutting

A method for die-cutting a label laminate comprises providing a cutting die of the rotary die-cutting machine having cutting tools, wherein the cutting edge parameters, such as effective height, shape and/or a bevel angle have been optimized for the label laminate to be cut. The parameters may be optimized based on the determined difference in the die-cutting properties of the label laminate and the specified features of the labels to be aligned along the first direction and the second direction of the label laminate. According to an example, the parameters may be optimized based on the die-cutting force (N/15 mm) of the facestock and/or label laminate in machine and in transverse direction, and/or the maximum and the minimum total contact lengths of the cutting edges of the cutting tools contacting the label laminate surface in the nip line.

Prior to cutting the label laminate is arranged between the cutting roll comprising the cutting die and a surface of an anvil roll spaced from the cutting roll. During cutting a cutting pressure is provided so as to provide a cutting force cutting a facestock layer and an adhesive layer of the label laminate by the cutting edges in the nip line.

The method is especially suitable for cutting label laminate having a plastic facestock layer exhibiting asymmetry based on different orientation ratios in machine and transverse direction of the facestock. The plastic facestock layer may be uniaxially oriented in machine direction, which has the die-cutting force (N/15 mm) in transverse direction higher than in machine direction.

Due to the difference between the die-cutting force (N/15 mm) in transverse direction and in the machine direction the method further comprises adjusting the cutting pressure so as to enable higher die-cutting force in the transverse direction when compared to the machine direction. The cutting pressure may be adjusted through providing difference in a height, shape and/or a bevel angle of the cutting edges in the machine and transverse directions, which equalizes the difference in the die-cutting force.

According to an example, the cutting edges in the first direction of the cutting tools are arranged parallel to the transverse direction of the label laminate to be cut and the cutting edges in the second direction are arranged parallel to the machine direction of the label laminate to be cut. Thus, the method of designing comprises adjusting the cutting pressure so as to enable higher die-cutting force in the transverse direction when compared to the machine direction of the label laminate through providing difference in height, shape and/or bevel angle of the cutting edges in the first direction when compared to the cutting edges in the second direction for diminishing the difference in the die-cutting force.

The method may further comprise providing difference in a height, shape and/or a bevel angle of the cutting edges based on the maximum and the minimum total contact lengths of the cutting edges of the cutting tools contacting the laminate surface on a nip line. Difference in the cutting edge parameters may enable diminishing the difference in the effective cutting pressures in the nip line between the maximum and the minimum total contact lengths of the cutting edges. With reference to FIG. 8, the maximum total contact length of the cutting edges contacting the laminate surface in the nip line consist of the cutting edges $E_{TD}$ i.e. the total length of the contact points $CL_1$. The minimum total contact length of the cutting edges contacting the laminate surface in the nip line consist of the contact points of the cutting edges $E_{MD1}$ and $E_{MD2}$ i.e. the total length of contact points $CL_2$. According to an example, the cutting die is arranged so that a maximum total contact length of the cutting edges is arranged parallel to the transverse direction of the label laminate to be cut.

The invention claimed is:

1. A cutting die for rotary die-cutting of a label laminate comprising cutting tools having cutting edges projecting out from a base surface of the cutting die and arranged at least in a first direction and a second direction along the base surface, wherein at least one of the following parameters of the cutting edges effective height, shape and bevel angle is arranged to be different in the first direction when compared to the second direction, wherein the cutting edges are arranged separately in the first direction and in the second direction along the base surface of the cutting die based on:

a determined difference in the die-cutting properties of the label laminate, and number and shape of the labels to be aligned along the first direction and the second direction of the label laminate;

wherein the cutting die is a sheet, and wherein the sheet comprises a further material layer on the surface opposite to the base surface so as to provide difference of the effective height between the cutting edges in the first direction and in the second direction.

2. A cutting die according to claim 1, wherein the difference of the effective height between the cutting edges in the first direction and in the second direction is between 5 and 15 μm.

3. A cutting die according to claim 1, wherein the difference of the bevel angle between the cutting edges in the first direction and in the second direction is between 5 to 25°.

4. A cutting die according to claim 1, wherein the first direction is a transverse direction of the cutting die and the second direction is perpendicular to the first direction.

5. A cutting die according to claim 1, wherein a transverse direction of the cutting die is parallel to a transverse direction of the label laminate to be cut.

6. A method of cutting labels, including providing the cutting die according to claim 1, and further comprising a step of providing a cutting roll for rotary die-cutting of a label laminate web so as to form individual labels attached on a release liner.

7. A cutting die according to claim 1, wherein the determined difference in the die-cutting properties of the label laminate involves die-cutting force in the first direction corresponding to a transverse direction and in the second direction corresponding to a machine direction of the label laminate.

8. A cutting die according to claim 1, wherein the cutting edges being arranged separately for the cutting edges arranged in the first direction and in the second direction is based on predetermined cutting pressure, the measured die-cutting forces, and the determined maximum and minimum contact lengths of the cutting edges of the cutting tools contacting the label laminate surface in a nip line.

9. A method for die-cutting a label laminate, wherein the method comprises providing the cutting die of the rotary die-cutting machine according to claim 1, arranging the label laminate between an anvil roll and a cutting roll comprising the cutting die spaced from the anvil roll;

providing a cutting pressure so as to provide a cutting force cutting a facestock layer and an adhesive layer of the label laminate by the cutting edges of the cutting tools of the cutting die in a nip line.

10. A method according to claim 9, wherein the label laminate has a plastic facestock layer having asymmetry based on different orientation ratio in a machine direction in comparison to a transverse direction of the facestock layer.

11. A method according to claim 10, wherein the plastic facestock layer is uniaxially oriented in the machine direction.

12. A method according to claim 11, wherein the plastic facestock layer has the die-cutting force in the transverse direction higher than in the machine direction.

13. A method according to claim 9, wherein the method comprises adjusting the cutting pressure so as to enable higher die-cutting force in a transverse direction when compared to a machine direction of the label laminate through providing difference in at least one of height, shape and bevel angle of the cutting edges in the first direction when compared to the cutting edges in the second direction for diminishing the difference in the die-cutting force.

* * * * *